US007370945B2

(12) United States Patent
Ueda

(10) Patent No.: US 7,370,945 B2
(45) Date of Patent: May 13, 2008

(54) INKJET HEAD

(75) Inventor: Masato Ueda, Akishima (JP)

(73) Assignee: Konica Minolta Holdings, Inc. (JP)

( * ) Notice: Subject to any disclaimer, the term of this patent is extended or adjusted under 35 U.S.C. 154(b) by 364 days.

(21) Appl. No.: 11/286,466

(22) Filed: Nov. 25, 2005

(65) Prior Publication Data

US 2006/0119675 A1 Jun. 8, 2006

(30) Foreign Application Priority Data

Dec. 3, 2004 (JP) ..... 2004-351478

(51) Int. Cl.
*B41J 2/05* (2006.01)

(52) U.S. Cl. ..... 347/65

(58) Field of Classification Search ..... 347/20, 347/44, 47, 63, 65, 66
See application file for complete search history.

(56) References Cited

U.S. PATENT DOCUMENTS 5,332,466 A * 7/1994 Nozawa ..... 216/27
5,808,644 A * 9/1998 Imamura et al. ..... 347/93
6,409,323 B1 * 6/2002 Silverbrook ..... 347/85
6,449,831 B1 * 9/2002 Komplin et al. ..... 29/611

FOREIGN PATENT DOCUMENTS

JP 2004-090494 3/2004

* cited by examiner

*Primary Examiner*—Anh T. N. Vo
(74) *Attorney, Agent, or Firm*—Lucas & Mercanti, LLP

(57) ABSTRACT

An ink jet head in which a head chip on which a nozzle for jetting ink and an ink supply port that is communicated with the nozzle are formed and a manifold on which an ink channel connecting port and a groove communicating with the ink channel connecting port are formed, are provided, and an ink channel in which a spacer occupying a part of a space in the groove is arranged in the groove is formed by connecting a face on which the ink supply port of the head chip is formed, to a face on which the groove of the manifold is formed. An ink path is formed so as to be capable of being communicated from the ink channel connecting port to the groove through the ink channel.

10 Claims, 9 Drawing Sheets

INKJET HEAD

This application is based on Japanese Patent Application No. 2004-351478 filed on Dec. 3, 2004, which is incorporated hereinto by reference.

BACKGROUND OF THE INVENTION

The present invention relates to an inkjet head, and in particular, to a structure of a manifold for connecting an ink supply route to a head chip on which a nozzle for jetting ink is formed.

On an inkjet head installed on an inkjet printer, there is provided a head chip on which an ink-jetting nozzle is formed. This head chip includes one on which singular or plural nozzle rows each having plural nozzles which are open in the same direction to form a line in one direction, are formed. A head is fixed on a carriage of a printer main body to be installed thereon. On the head chip, there is provided an actuator element such as a piezoelectric element that gives the jetting force to a nozzle.

As is used in the inkjet head described in Patent Document 1, a manifold representing a component for connecting an ink supply route to a head chip is used. As a manifold, resin molded components are preferably used.

On the outer surface of the head chip, there is formed an ink supply port that is communicated with a nozzle to be open. On the manifold, there are formed a channel connection port and a groove that is communicated with the channel connection port. When the groove on the manifold is applied to the ink supply port, and an ink supply pipe is connected to the channel connection port on the manifold, the manifold connects the ink supply route to the head chip.

(Patent Document 1) TOKKAI No. 2004-090494

The channel on the manifold needs to be designed in accordance with ink characteristics such as ink discharge and ink viscosity in the course of recording operations. Heretofore, the manifold has been made in full measure for each channel characteristic required for the manifold. For example, even in the case of new requirements to enlarge or to downsize a cross-sectional area of a channel, there has been designed and manufactured a manifold whose cross-sectional area of a channel is enlarged or downsized, to be used. Therefore, there have been occasions wherein a manifold is redesigned each time ink is changed, for example, and a manifold is redesigned for changing ink discharge even in the same ink.

Meanwhile, there is sometimes an occasion wherein jetting characteristics of a nozzle are affected by heat that is generated by driving of a head chip and is filled therein. If heat is maldistributed in the head chip, jetting characteristic of a nozzle varies depending on a position of the nozzle, and its performance is affected. Heat maldistributed in the head chip is diffused through ink filled in the manifold, and is made uniform.

However, the smaller the cross-sectional area of a channel of the manifold is made, the more serious the problem of unevenness of heat generated in the head chip is, and jetting characteristics between nozzles in the head are fluctuated by distribution of ink temperature.

SUMMARY OF THE INVENTION

With the foregoing as a background, an object of the invention is to enhance efficiency of utilization of a manifold component by a structure of a manifold for connecting an ink supply route with a head chip on which a nozzle is formed, in an ink jet head.

Further, an object of the invention is to restrain a decline of thermal conductivity caused by a reduction of a cross-sectional area of a channel of the manifold, and thereby to accelerate uniformization of uneven heat generated in the head chip.

The object mentioned above can be attained by any one of the following Structures (1)-(10).

Structure (1): An ink jet head in which a head chip on which a nozzle for jetting ink and an ink supply port that is communicated with the nozzle are formed and a manifold on which an ink channel connecting port and a groove communicating with the ink channel connecting port are formed, are provided, and an ink channel in which a spacer occupying a part of a space in the groove is arranged in the groove is formed by connecting a face on which the ink supply port of the head chip is formed, to a face on which the groove of the manifold is formed, wherein an ink path is formed so as to be capable of being communicated from the ink channel connecting port to the groove through the ink channel.

Structure (2): The ink jet head described in Structure (1) wherein the spacer is held at a fixed position in the groove.

Structure (3): The ink jet head described in Structure (1) wherein the spacer is formed solidly along the shape of the groove.

Structure (4): The ink jet head described in Structure (1) wherein the spacer has its bottom portion engaging with a bottom of the groove and an edge wall portion that is provided on the edge of the bottom portion and keeps a gap between the head chip and the bottom portion.

Structure (5): The ink jet head described in Structure (1) wherein the spacer is composed of two or more parts.

Structure (6): The ink jet head described in Structure (1) wherein the spacer has a layer structure of two or more layers.

Structure (7): The ink jet head described in Structure (1) wherein the whole of the spacer or a portion where an inner surface of the ink channel is formed is made of a material whose thermal conductivity is $\delta 1$, and the whole of the manifold or a portion where the groove is formed is made of a material whose thermal conductivity is $\delta 2$, under the condition of $\delta 1/\delta 2>1$.

Structure (8): The ink jet head described in Structure (1) wherein the whole of the spacer or a portion where an inner surface of the ink channel is formed is made of a material whose thermal conductivity is $\delta 1$, and the whole of the manifold or a portion where the groove is formed is made of a material whose thermal conductivity is $\delta 2$, under the condition of $\delta 1/\delta 2>20$.

Structure (9): The ink jet head described in Structure (1) wherein the whole of the spacer or a portion where an inner surface of the ink channel is formed is made of a material whose thermal conductivity is $\delta 1$, and thermal conductivity of ink to be used is $\delta 3$, under the condition of $\delta 1/\delta 3>1$.

Structure (10): The ink jet head described in Structure (1) wherein the whole of the spacer or a portion where an inner surface of the ink channel is formed is made of a material whose thermal conductivity is $\delta 1$, and thermal conductivity of ink to be used is $\delta 3$, under the condition of $\delta 1/\delta 3>20$.

Figure 7:
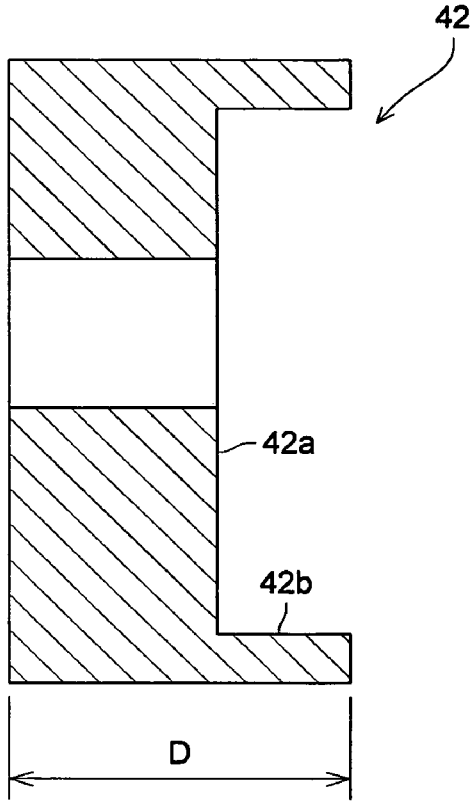
Figure 7:
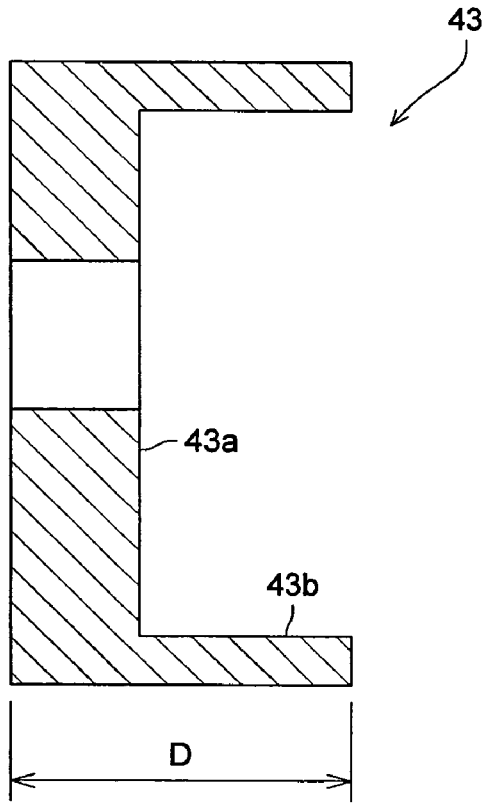

Each of FIGS. 7 (*a*)-7 (*b*) is a cross-sectional view of a channel spacer in an embodiment of the invention.

Figure 8:
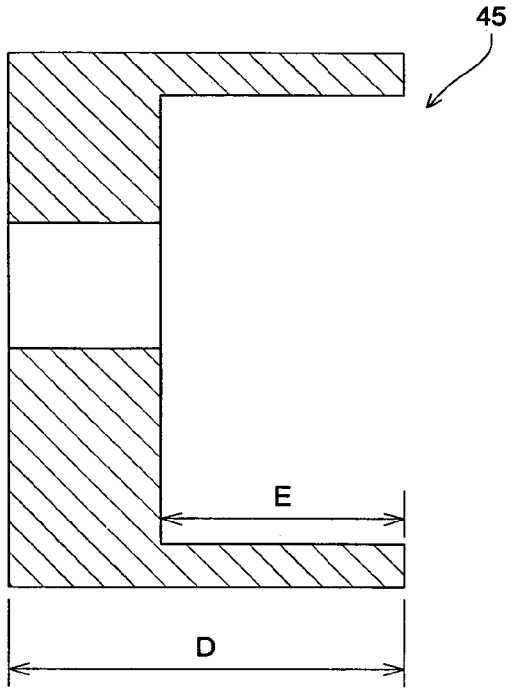
Figure 8:
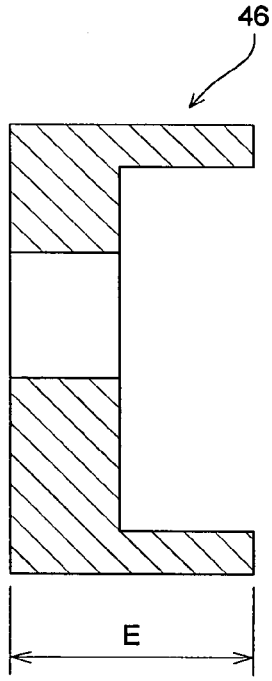
Figure 8:
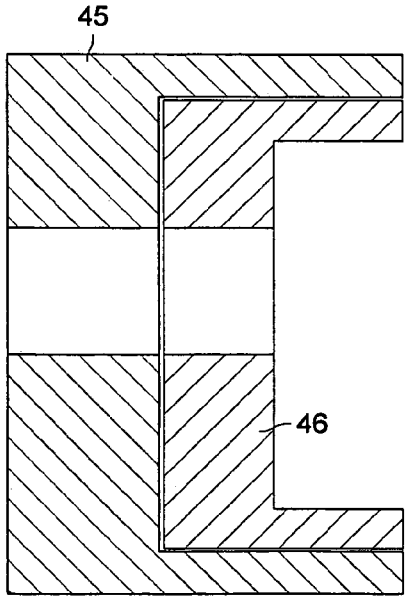
Figure 8:
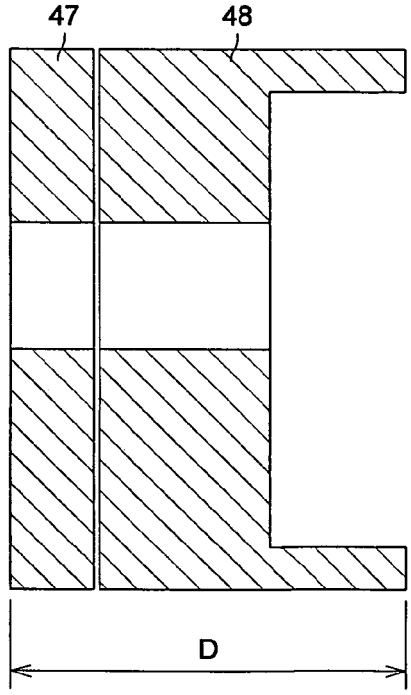

Each of FIGS. 8 (*a*)-8 (*d*) is a cross-sectional view of a channel spacer in an embodiment of the invention.

Figure 9:
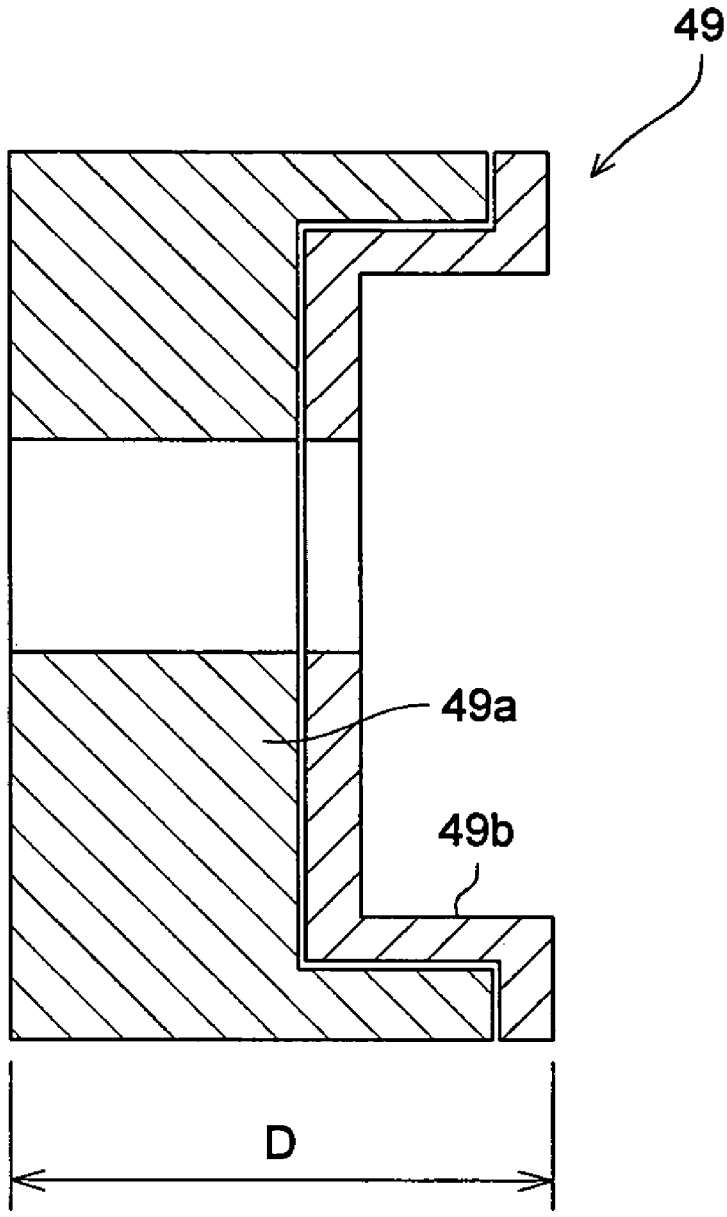

FIG. 9 is a cross-sectional view of a channel spacer in an embodiment of the invention.

DETAILED DESCRIPTION OF THE PREFERRED EMBODIMENT

Figure 1:
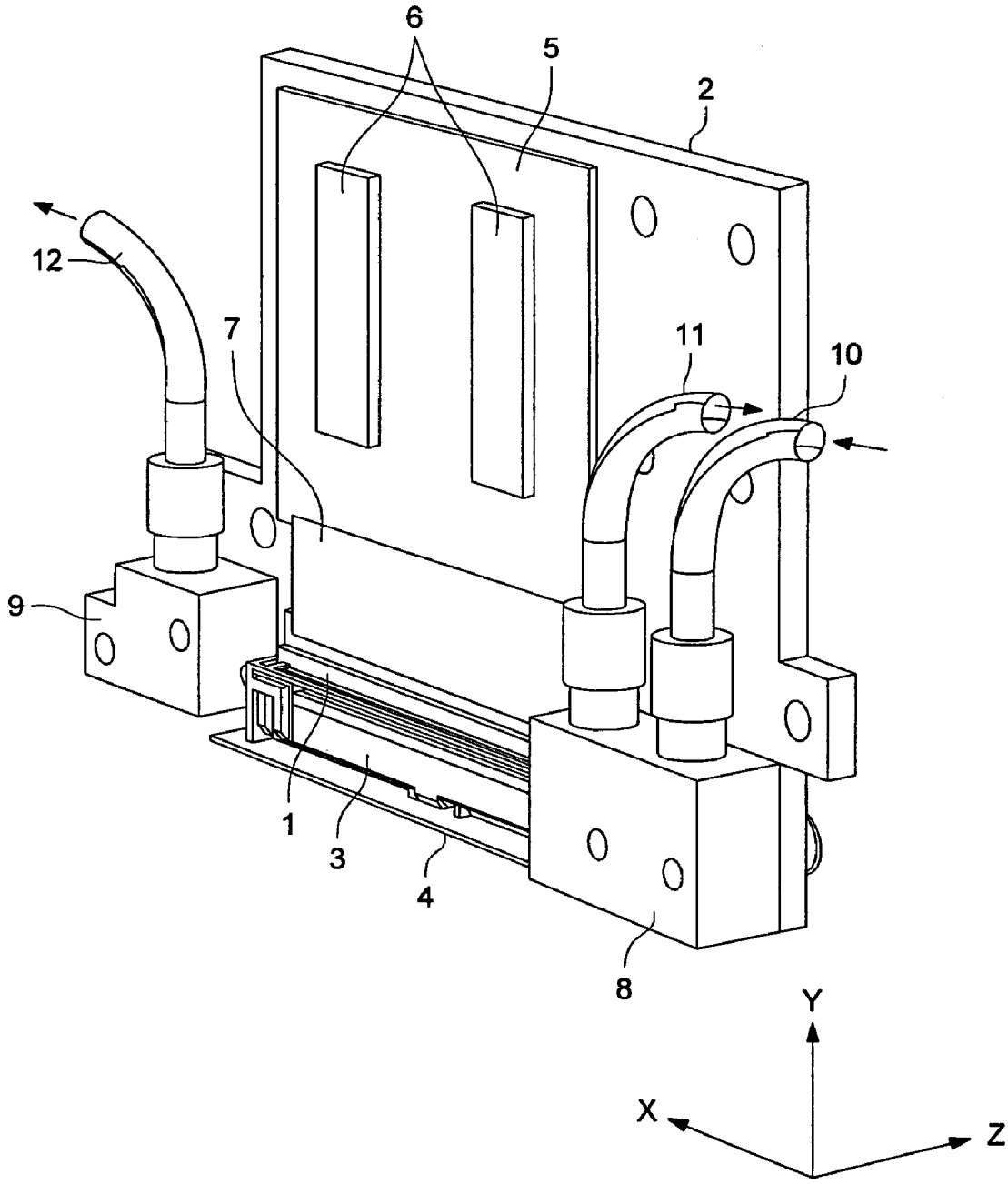
FIG. 1 shows a total perspective view (the face side) of an inkjet head in an embodiment of the invention.
Figure 2:
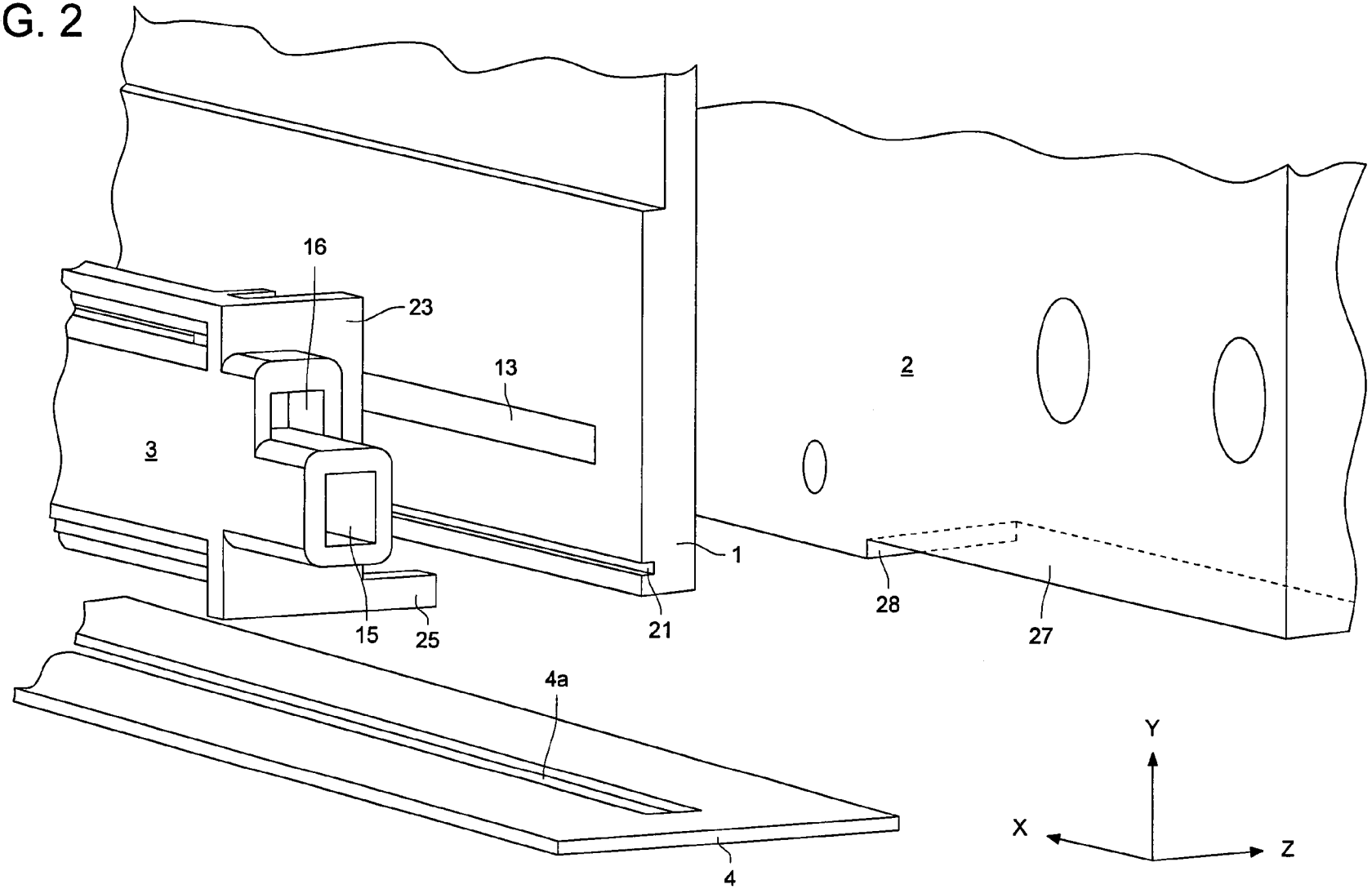
FIG. 2 shows an exploded and partial perspective view of an inkjet head in an embodiment of the invention.
Figure 3:
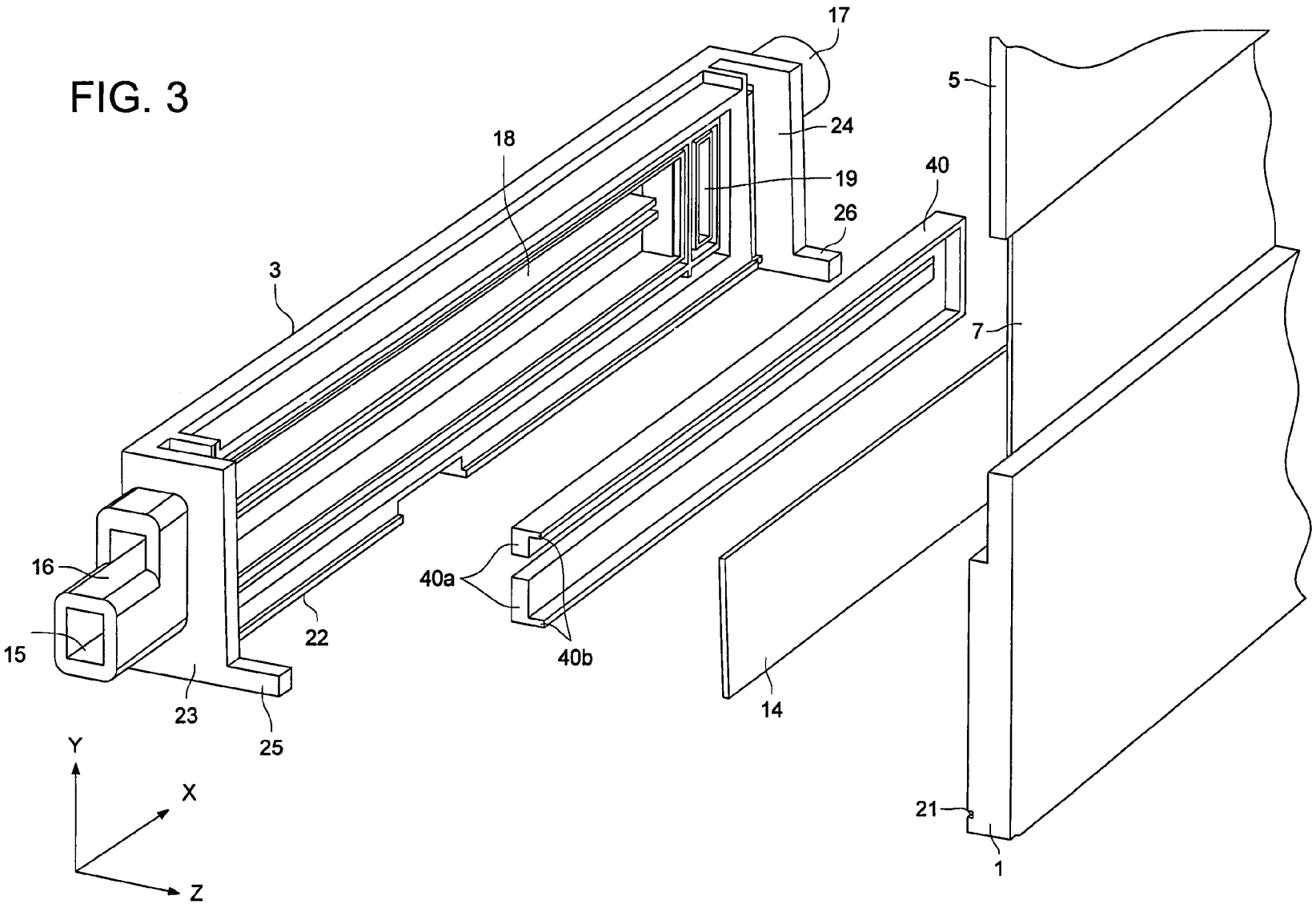
FIG. 3 shows an exploded and partial perspective view of an inkjet head in an embodiment of the invention.
Figure 4:
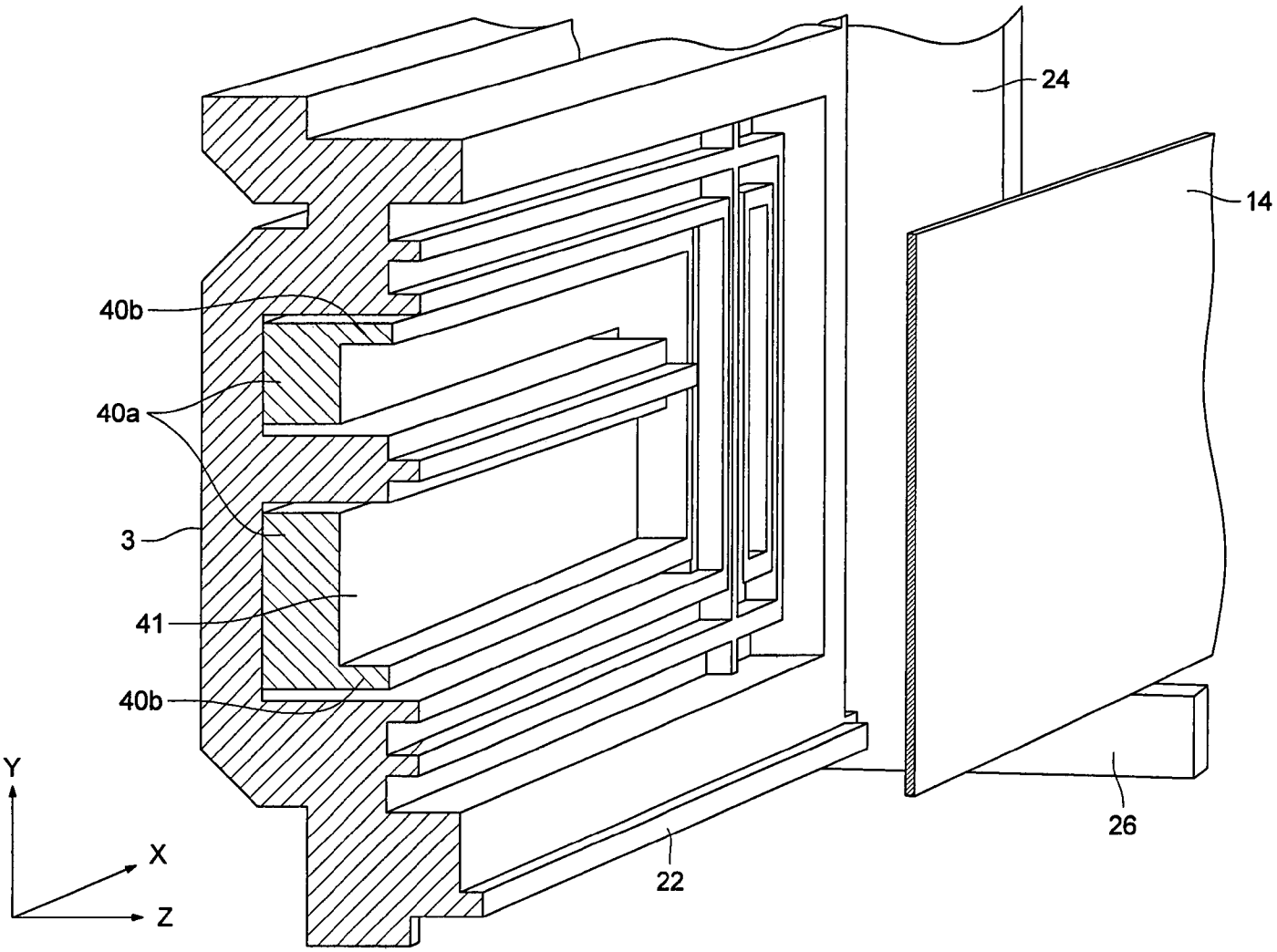
FIG. 4 shows a cross-sectional, exploded and partial perspective view of an inkjet head in an embodiment of the invention.
Figure 5:
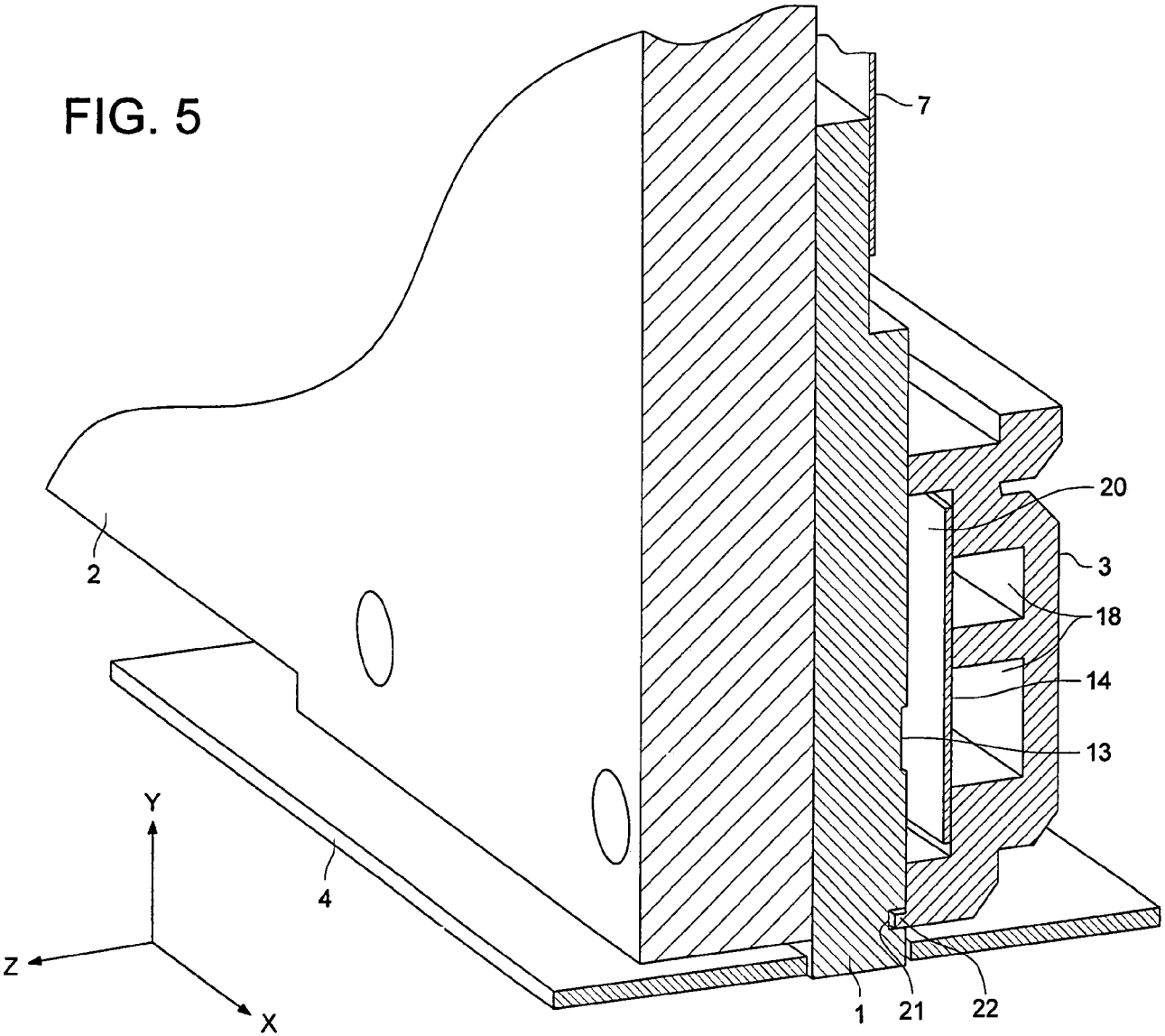
FIG. 5 shows a cross-sectional and partial perspective view (without spacer) of an inkjet head in an embodiment of the invention.
Figure 6:
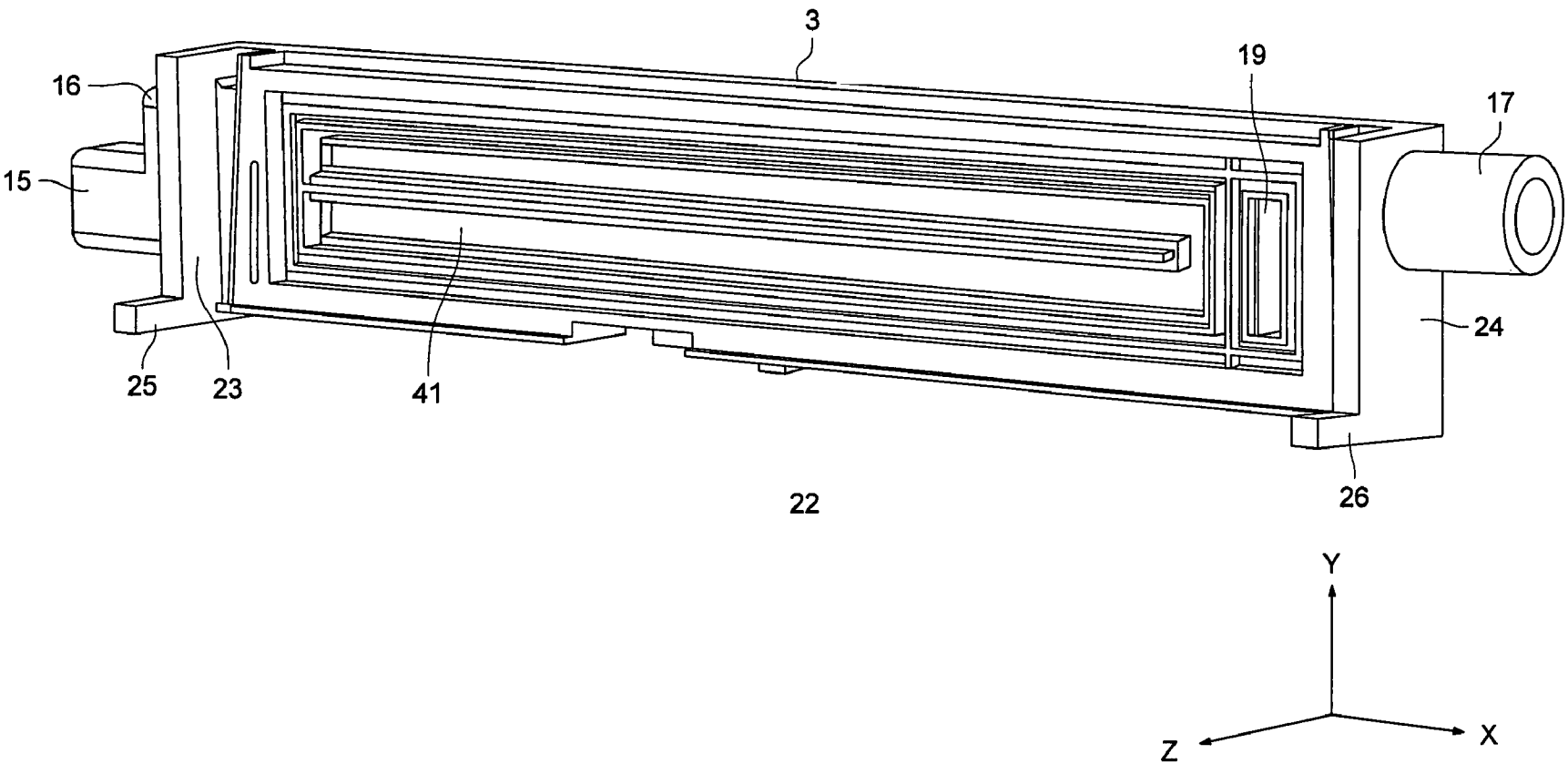
FIG. 6 shows an individual perspective view (with spacer) of a manifold in an embodiment of the invention.

An embodiment of the invention will be explained as follows, referring to the drawings. The undermentioned is an embodiment of the invention and it does not limit the invention. FIG. 1 shows a total perspective view of an inkjet head in an embodiment of the invention. Each of FIG. 2 and FIG. 3 shows an exploded and partial perspective view, FIG. 4 shows a cross-sectional, exploded and partial perspective view and FIG. 5 shows a cross-sectional and partial perspective view (without spacer). FIG. 6 shows an individual perspective view (with spacer) of a manifold. X, Y and Z axes which are common to all drawings are indicated on each of the drawings.

An inkjet head of the present embodiment is equipped with head chip 1, frame 2, manifold main body 3, cap backup plate 4, circuit board 5, connector 6 and flexible wiring board 7.

On the circuit board 5, those including connector 6, a driving circuit (not shown) and others are mounted. One end of the flexible wiring board 7 is connected to the circuit board 5, and the other end thereof corresponds to rows of nozzles and is connected with pairs of electrodes exposed on the surface of the head chip 1. On the head chip 1, there is structured a row of nozzles standing in a line in the X direction. On each nozzle, there is provided an actuator element such as a piezoelectric element. The actuator element is connected to the pairs of electrodes.

In accordance with signals inputted from the connector 6, a driving circuit on the circuit board 5 generates drive voltage which is applied on the actuator element through the flexible wiring board 7 and pairs of electrodes to give jetting force to the nozzle by pressurizing an ink chamber located in front of the nozzle.

On the surface of the head chip 1, there is formed ink supply port 13 that is communicated with a nozzle, to be open. On the inner side facing the head chip 1 of the manifold main body 3, there is formed a groove 18 to become an ink channel as shown in FIG. 3.

As shown in FIG. 3, FIG. 4 and FIG. 6, channel spacer 40 is provided in laid-U-shaped groove 18 of the manifold main body 3. As shown in FIG. 5, filter 14 is provided on the upper portion of the laid-U-shaped groove 18 of the manifold main body 3. Incidentally, the filter 14 is deposited by melting a rib provided on the edge of the groove 18.

The channel spacer 40 occupies a part of the space in the groove 18 to reduce a cross-sectional area of the channel formed by the groove 18. The channel spacer 40 is formed solidly to be in a U-shaped form, following the shape of the groove 18, and it can be taken out or put in freely through the upper end opening of the groove 18, in the course of assembling.

The channel spacer 40 is composed of bottom portion 40*a* and side wall portion 40*b*. The bottom portion 40*a* has a shape and size which fit in a bottom of the groove 18. The side wall portion 40*b* is provided to stand on the edge of the bottom portion 40*a*. A thickness of the bottom portion 40*a* is smaller than a depth of the groove 18. When the channel spacer 40 is placed in the groove 18, a top portion of the side wall portion 40*b* has a height up to which the filter 14 of the groove 18 is set up.

Owing to the aforesaid structure, when the filter is attached, the channel spacer 40 is held at a fixed position in the groove 18. The side wall portion 40*b* is stopped by the filter 14 to maintain the gap between the head chip 1 and the bottom portion 40*a*.

When placing the channel spacer 40, U-shaped groove 41 that is a size smaller than the inside of the U-shaped groove 18 is formed by the channel spacer 40, and a channel is formed by this groove 41. When the channel spacer 40 is not placed, the channel is formed by the groove 18.

Manifold main body 3 veils the surface of head chip 1 and covers ink supply port 13.*of* the head chip 1 to connect an ink channel formed by its groove to the ink supply port 13 of the head chip 1.

Channel connecting components 8 and 9 are attached respectively on both sides of chip-installing surface of frame 2. On the top surface of the channel connecting component 8, there are connected pipes 10 and 11, and on the inner side surface of the channel connecting component 8, there are connected side connection ports (also referred to as ink channel connecting ports) 15 and 16 of the manifold main body 3. On the top surface of the channel connecting component 9, there is connected pipe 12, and on the inner side surface of the channel connecting component 9, there is connected side connection port 17 of the manifold main body 3.

Ink is supplied from pipe 10. Communication is made from pipe 10 to pipe 11 through the channel connecting component 8, by passing through ink channel connecting port (side connection port) 15 of the manifold main body 3, then, groove 18 and ink channel connecting port (side connection port) 16, and ink flows before passing through the filter 14 in the manifold main body 3. As shown in FIG. 5, ink that has passed the filter 14 in the groove 18 is given to ink supply port 13 through channel 20 formed in a form of a gap between the filter 14 and the head chip 1. Further, the channel 20 is communicated to pipe 12 through grooves 19 shown in FIGS. 3 and 6, ink channel connecting port (side connection port) 17, and further, through the channel connecting component 9 shown in FIG. 1, thus, ink in the channel 20 can be discharged.

Ink supplied from ink supply port 13 to head chip 1 is passes through the aforesaid ink path and jetted out of a nozzle by driving of the aforesaid actuator element.

Cap backup plate 4 is arranged in a way that a lower end portion of the head chip 1 is engaged in opening 4*a* formed at the center of the cap backup plate 4.

One object of the cap backup plate 4 is to cause a cap (not shown) to adhere closely. This cap adheres closely to the cap backup plate 4 that surrounds the head chip 1, to cover a lower end surface where an ink jetting port of a nozzle of the head chip 1 is formed to be open. On the cap, there is sometimes connected a suction device (not shown) which sucks ink from a nozzle of the head chip 1 through the cap adhering closely to the cap backup plate 4.

As frame 2, preferable is one that is composed of a plate material such as a metal plate, and has an excellent board thickness precision. Holes for attaching are provided on the frame 2.

The head chip 1 is mounted on the surface of the frame 2. A reverse side of the head chip 1 and surface of the frame 2 are put together so that they face each other, and the head chip 1 is mounted on the frame 2 under the condition that a lower end of the head chip 1 is projected out of a lower end of the frame 2.

After building up the structure stated above, resins are made to adhere to the circumference of manifold main body 3, and are made to become hardened, thereby, respective parts are fixed on the frame 2, and a clearance is made not to be generated in a channel.

When mounting the present inkjet head on a printer main body, they are fixed by bolts by the use of holes made on the frame 2, under the circumstances that the reverse surface of the frame 2 is supported by a surface of a member provided on the main body side.

By selecting to install or not to install a channel spacer such as that stated above, it is possible to constitute channels each being different from others on the manifold.

Further, as shown in FIGS. 7(*a*) and 7(*b*), for example, it is possible to constitute channels each being different from others on the manifold, by selecting a shape and a size of the spacer to be installed.

Each of the FIGS. 7(*a*) and 7(*b*) is a cross-sectional view of a channel spacer each having a different thickness. Channel spacer 42 shown in FIG. 7(*a*) is composed of bottom portion 42*a* and edge wall portion 42*b*. Channel spacer 43 shown in FIG. 7(*b*) is composed of bottom portion 43*a* and edge wall portion 43*b*. The bottom portion 42*a* on the other hand is formed to be thicker than the bottom portion 43*a* on the other side. A height from the bottom surface of the bottom portion 42*a* to the upper end of the edge wall portion 42*b* in the channel spacer 42 on one side and a height from the bottom surface of the bottom portion 43*a* to the upper end of the edge wall portion 43*b* in the channel spacer 43 on the other side are the same each other to be of dimension D. This dimension D is made to agree with a height from the bottom of groove 18 of manifold main body 3 to the surface on which the filter 14 is installed (the same in FIGS. 8(*a*)-8(*d*) and FIG. 9). Dimensions of both channel spacers 42 and 43 other than the aforesaid height are made to agree with dimensions of grooves 18 of manifold main body 3.

By making a plurality of channel spacers each having a different thickness of a bottom portion, and by selecting them, it is possible to constitute simply and quickly a channel path having a different depth in the manifold.

By making a plurality of channel spacers each having a different thickness of an edge wall portion, and by selecting them, it is possible to constitute simply and quickly a channel path having a different width in the manifold.

In addition, by making channel spacers each having a different type, and by selecting them, it is possible to constitute simply and quickly channels in various types in the manifold.

It is also effective to constitute the channel spacer of two or more parts. As shown in FIG. 8(*a*), for example, there is made channel spacer 45 that is composed of a bottom portion and an edge wall portion and has an external form which is engaged with groove 18 of manifold main body 3 and can be housed therein. On the other hand, as shown in FIG. 8 (*b*), there is made channel spacer 46 that is composed of a bottom portion and an edge wall portion and has an external form which is engaged with the inside of the channel spacer 45 and can be housed therein. Dimensions D and E are made to be the same as those illustrated.

By installing channel spacer 45 in groove 18 of manifold main body 3, a channel whose cross-sectional area is smaller than that of groove 18 of manifold main body 3 can be formed.

As shown in FIG. 8(*c*), further, by installing channel spacer 46 in the channel spacer 45 to use it, a channel whose cross-sectional area is further smaller can be formed.

In addition, one effective method is to constitute a channel spacer with two or more parts which can be divided into an upper portion that comes in contact with ink and a lower portion that does not come in contact with ink, as in the structure shown in FIG. 8 (*d*), although it is possible to constitute a channel spacer with two or more parts through various types of structures. FIG. 8(*d*) shows a channel spacer wherein plate-shaped spacer 47 and spacer 48 having a bottom portion and an edge wall portion are combined.

Further, it is also effective to constitute a spacer with a layer structure of two or more layers. For example, there is given channel spacer 49 wherein coating layer 49*b* such as a metal film is provided on the surface of base material 49*a* having therein a bottom portion and an edge wall portion, as shown in FIG. 9.

In the case of an object of design change for a channel, the same material is enough to be used for manifold main body 3, channel spacers 40, 42, 43, 45, 46, 47 and 48 as well as base material 49*a*, and resin molded components are put into practice. In the case of an object of improvement of thermal conductivity, a material having excellent conductivity such as metal is used as a material for channel spacers 40, 42, 43, 45, 46, 47 and 48 as well as base material 49*a*. In the channel spacer composed of two components including channel spacer 45 and channel spacer 46 shown in FIG. 8(*c*), it is possible to use a material having low thermal conductivity such as resin for the channel spacer 45 and to use a material having high thermal conductivity such as metal for the channel spacer 46, or, it is possible to use a material having high thermal conductivity such as metal for both of them. In the channel spacer composed of two components shown in FIG. 8(*d*), it is possible to use a material having low thermal conductivity such as resin for the channel spacer 47 and to use a material having high thermal conductivity such as metal for the channel spacer 48, or, it is possible to use a material having high thermal conductivity such as metal for both of them. In the channel spacer 49 shown in FIG. 9, it is possible to use a material having low thermal conductivity such as resin for base material 49*a* and to use a material having high thermal conductivity such as metal for coating layer 49*b*, or, it is also possible to use a material having high thermal conductivity such as metal for both of them.

In this case, the symbol δ1 represents the thermal conductivity of each portion of the spacer or of a portion that forms an inner surface of an ink channel, δ2 represents the thermal conductivity of each portion of a manifold or of a portion that forms a groove of a channel for the manifold, and δ3 represents the thermal conductivity of ink to be used. In the case of the spacer composed of two parts shown in each of FIGS. 8(*c*) and 8(*d*), the thermal conductivity of each component of the spacer or of each of channel spacers 46 and 48 corresponds to δ1. In the case of the channel spacer 49, the thermal conductivity of each constituent material of the spacer or of coating layer 49 corresponds to δ1. Even in the case of a manifold, when a portion where a groove for a channel is formed is different from other portions in terms of material, the thermal conductivity of that portion only may be made to correspond to δ2, or the thermal conductivity of respective constituent materials may be made to correspond to δ2.

In the case of an object of improvement of thermal conductivity inside an ink channel formed by the manifold, materials need to be selected so that δ1/δ2>1 and δ1/δ3>1, preferably, δ1/δ2>20 and δ1/δ3>20 may hold.

For example, for a manifold main body made of resin having thermal conductivity of 0.1-0.5 (W/m·K), aluminum (thermal conductivity of 238 (W/m·K)), stainless steel (thermal conductivity of 16 (W/m·K)) or alumina (thermal conductivity of 21 (W/m·K)). The thermal conductivity of ink to be used, for example, is about 0.4 (W/m·K).

In addition, as a material that can be used and shows high thermal conductivity, there are given, for example, silver, copper, nickel, iron, gold, platinum, tin-lead and magnesium, to which, however, the invention is not limited.

EXAMPLE

By using an inkjet head with a head drive frequency of 10 kHz and with a head channel number of 128, a difference of ink temperature between both ends of $64^{th}$ channel of a drive head in the inner part of a channel in the course of continuous driving was measured. Aqueous ink whose viscosity is 4 cp was used. Power consumption was about 0.3 W/64 channel. By using the same manifold made of PPS (glass fiber 30%), a difference of ink temperature between both ends was measured by driving under the aforesaid conditions, for three occasions including (1) where only manifold (without a spacer) was used, (2) where a spacer made of the same material as in the manifold was used and (3) where a spacer made of aluminum having the same form as in the spacer used in (2) was used. The results are tabulated in Table 1.

TABLE 1

| | | |
|---|---|---|
| (1) | Manifold only (without spacer) | 1.3° C. |
| (2) | Spacer made of the same material as in the manifold | 3.2° C. |
| (3) | Spacer made of aluminum having the same form as in the spacer for manifold | 0.6° C. |

As shown in Table 1, a temperature difference is reduced at both ends.

The temperature difference is within a tolerance in an ordinary precision (±10%), but, this figure turns out to be a value which cannot be ignored when driving at a high precision (±1%) is needed.

In the invention, an ink channel connected to a head chip through a manifold can be formed, and a spacer occupying a part of the space in the groove is installed in the groove of the manifold, whereby, a different channel can be built in the manifold, by selecting whether installing this spacer or not in the course of manufacturing and by selecting a shape and a size of the spacer to be installed. A manifold main body representing a manifold part other than the spacer can be shared by manifolds each having a different channel, thus, efficiency of utilization of manifold parts can be enhanced.

In the Structure (2), a channel by the manifold is formed to be constant, because the spacer is held at a fixed position in the groove of the manifold.

In the Structure (3), the spacer can be installed easily, because the spacer is formed solidly following a form of the groove of the manifold.

In the Structure (4), the spacer has a bottom portion engaged with a bottom of the groove of the manifold and an edge wall portion that maintains a gap between a head chip provided on the bottom edge and the bottom portion, whereby, it is possible to fix the spacer to form a certain ink channel without using adhesives, just by installing the spacer in the groove of the manifold and by aligning to the head chip.

In the Structure (5), it is possible to select materials on a right material in the right place basis, to select a suitable manufacturing method for each part and to accelerate standardization of parts, because the spacer is composed of two or more parts.

In the Structure (6), it is possible to select materials on a right material in the right place and to select a suitable manufacturing method for each layer, because the spacer has a layer structure of two or more layers.

In the Structure (7), the thermal conductivity of at least a portion where an ink channel is formed is greater than that of the whole of the manifold or of a portion where a groove of the manifold is formed, whereby, a decline of thermal conductivity is reduced even when a cross-sectional area of the channel of the manifold is reduced by installation of the spacer, and heat generated locally on the head chip is transmitted by the spacer more effectively than a member where a groove of the manifold is formed, to be uniformalized.

In the Structure (8), the thermal conductivity of at least a portion where an ink channel is formed is greater than 20 times that of the whole of the manifold or of a portion where a groove of the manifold is formed, whereby, it is possible to improve drastically thermal conductivity in the ink channel by the material used widely at a low figure, by installing a spacer made of metal for the manifold made of resin.

In the Structure (9), the thermal conductivity is improved and heat generated locally on the head chip is transmitted effectively to be uniformalized even when a cross-sectional area of the manifold is reduced by installation of the spacer, because the thermal conductivity of at least the portion where an ink channel is formed is greater than that of ink to be used.

In the Structure (10), the thermal conductivity of at least a portion where an ink channel is formed is greater than 20 times that of the whole of the manifold or of a portion where a groove of the manifold is formed, whereby, it is possible to improve drastically thermal conductivity in the ink channel by the material used widely at a low figure, by installing a spacer made of metal for the manifold made of resin.

What is claimed is:

1. An ink jet head comprising:

(a) a head chip on which a nozzle to jet ink and an ink supply port communicated with the nozzle, are formed:

(b) a manifold on which an ink channel connecting port and a groove communicated with the ink supply port, are formed; and (c) a channel spacer provided in the groove of the manifold, which occupies a part of a space in the groove, wherein an ink channel is formed by connecting a face on which the ink supply port of the head chip is formed, to a face on which the groove of the manifold is formed, and wherein an ink path is formed so as to be capable of being communicated from the ink channel connecting port to the groove through the ink channel.

2. The ink jet head of claim 1, wherein the channel spacer is held at a fixed position in the groove.

3. The ink jet head of claim 1, wherein the channel spacer is formed along a shape of the groove as a unit.

4. The ink jet head of claim 1, wherein the channel spacer has a bottom portion which is engaged with a bottom of the groove, and an edge wall portion that is provided on an edge of the bottom portion and keeps a gap between the head chip and the bottom portion.

5. The ink jet head of claim 1, wherein the channel spacer is composed of two or more parts.

6. The ink jet head of claim 1, wherein the channel spacer has a layer structure of two or more layers.

7. The ink jet head of claim 1, wherein a whole of the channel spacer or a part of the channel spacer forming an inner surface of the ink channel is composed of a material having thermal conductivity of $\delta 1$, and a whole of the manifold or a part forming the groove is composed of a material having thermal conductivity of $\delta 2$, and the following expression is satisfied:

$$\delta 1/\delta 2>1.$$

8. The ink jet head of claim 1, wherein a whole of the channel spacer or a part of the channel spacer forming an inner surface of the ink channel is composed of a material having thermal conductivity of $\delta 1$, and a whole of the manifold or a part forming the groove is composed of a material having thermal conductivity of $\delta 2$, and the following expression is satisfied:

$$\delta 1/\delta 2>20.$$

9. The ink jet head of claim 1, wherein a whole of the channel spacer or a part of the channel spacer forming an inner surface of the ink channel is composed of a material having thermal conductivity of $\delta 1$, and the ink to be used has thermal conductivity of $\delta 3$, and the following expression is satisfied:

$$\delta 1/\delta 3>1.$$

10. The ink jet head of claim 1, wherein a whole of the channel spacer or a part of the channel spacer forming an inner surface of the ink channel is composed of a material having thermal conductivity of $\delta 1$, and the ink to be used has thermal conductivity of $\delta 3$, and the following expression is satisfied:

$$\delta 1/\delta 3>20.$$

* * * * *